US008250800B1

(12) United States Patent
Johnson

(10) Patent No.: US 8,250,800 B1
(45) Date of Patent: Aug. 28, 2012

(54) RIFLE CHAMBER CLEANING TOOL WITH DEBRIS CAPTURING RECESSES

(75) Inventor: Sam Gilliam Johnson, Douglas, WY (US)

(73) Assignee: Combat Application Tools, Inc., Douglas, WY (US)

( * ) Notice: Subject to any disclaimer, the term of this patent is extended or adjusted under 35 U.S.C. 154(b) by 99 days.

(21) Appl. No.: 12/925,646

(22) Filed: Oct. 26, 2010

Related U.S. Application Data

(60) Provisional application No. 61/281,737, filed on Nov. 23, 2009.

(51) Int. Cl.
*F41A 29/02* (2006.01)

(52) U.S. Cl. ..... 42/95; 15/104.16

(58) Field of Classification Search ... 42/95; 15/104.16, 15/224; D22/109, 199
See application file for complete search history.

(56) References Cited

U.S. PATENT DOCUMENTS

| | | | | | |
|---|---|---|---|---|---|
| 350,847 | A | * | 10/1886 | Sherman | 15/104.18 |
| 449,080 | A | * | 3/1891 | Mackay | 15/104.16 |
| 484,487 | A | * | 10/1892 | Wunderlich | 15/104.18 |
| 1,258,737 | A | * | 3/1918 | Bemis | 15/104.2 |
| 1,786,520 | A | * | 12/1930 | Darling | 15/104.19 |
| 1,872,198 | A | | 8/1932 | Van Rixel | |
| 2,157,493 | A | * | 5/1939 | Miller et al. | 166/174 |
| 3,602,935 | A | * | 9/1971 | McDonnell et al. | 15/104.09 |
| 3,765,045 | A | * | 10/1973 | Schneider et al. | 15/104.18 |
| 4,843,750 | A | | 7/1989 | Blase | |
| 4,873,778 | A | | 10/1989 | Stipp | |
| 4,930,240 | A | | 6/1990 | Bice | |
| 5,557,871 | A | | 9/1996 | LaLonde | |
| D375,595 | S | | 11/1996 | Shumway et al. | |
| 5,588,242 | A | | 12/1996 | Hughes | |
| 6,085,376 | A | * | 7/2000 | Antal et al. | 15/104.061 |
| 6,691,446 | B2 | * | 2/2004 | Graves | 42/95 |
| D562,935 | S | | 2/2008 | Morgan | |
| D589,579 | S | | 3/2009 | Williams | |
| D601,688 | S | | 10/2009 | Abe et al. | |
| 2004/0244627 | A1 | | 12/2004 | Bice | |

FOREIGN PATENT DOCUMENTS

| | | |
|---|---|---|
| WO | 2007046856 | 4/2007 |
| WO | 2007087003 | 8/2007 |

* cited by examiner

*Primary Examiner* — Bret Hayes
(74) *Attorney, Agent, or Firm* — Antoinette M. Tease

(57) ABSTRACT

A rifle chamber cleaning tool comprising a single piece of material with an annular scraping head and a plurality of elongated fingers, comprising debris capturing chambers within the elongated fingers. The scraping head and fingers are shaped so as to fit snugly when inserted between the lug recesses inside the rifle chamber. The distance between the fingers is roughly equivalent to the distance between the locking lugs inside the rifle chamber.

3 Claims, 4 Drawing Sheets

RIFLE CHAMBER CLEANING TOOL WITH DEBRIS CAPTURING RECESSES

CROSS-REFERENCE TO RELATED APPLICATION

This application claims the benefit of provisional patent application Ser. No. 61/281,737, filed 2009 Nov. 23 by the present inventor.

BACKGROUND

Prior Art

The following is a tabulation of some prior art that presently appears relevant:

U.S. Patents

| U.S. Pat. No. | Kind Code | Issue Date | Patentee |
|---|---|---|---|
| 3,765,045 | B1 | Oct. 16, 1973 | Schneider et al |
| D562,935 | S | Feb. 26, 2008 | Morgan |
| 3,602,935 | B1 | Sep. 7, 1971 | McDonnell et al |
| 1,872,198 | B1 | Aug. 16, 1932 | Van Rixel |
| 5,588,242 | B1 | Dec. 31, 1996 | Hughes |
| D601,688 | S | Oct. 6, 2006 | Abe et al |
| D589,579 | S | Mar. 31, 2009 | Williams |
| 4,930,240 | B1 | Jun. 5, 1990 | Bice |
| 4,873,778 | B1 | Oct. 17, 1989 | Stipp |
| 4,843,750 | B1 | Jul. 4, 1989 | Blasé |
| D375,595 | S | Nov. 12, 1996 | Shumway et al |
| 5,557,871 | B1 | Sep. 24, 1996 | LaLonde |

U.S. Patent Application Publications

| Publication No. | Kind Code | Issue Date | Applicant |
|---|---|---|---|
| 20040244627 | A1 | Dec. 9, 2004 | Bice |

Foreign Patent Documents

| Foreign Doc. No. | Cntry Code | Kind Code | Pub. Dt. | App or Patentee |
|---|---|---|---|---|
| 2007087003 | US | A2 | Aug. 2, 2007 | Cioletti et al |
| 2007046856 | US | A2 | Apr. 26, 2007 | Williams |

Nonpatent Literature Documents

Graf, Master Catalog 2010, "Accessories-Brushes and Mops" page 250

Midway USA, Gunsmithing Catalog #31G "Special Purpose Brushes" page 364

Brownell's, Catalog #5 2010, "AR-15/M16 Upper Receiver Cleaning Kit" page 56

Sweeney, P. Guns and Ammo Book of the AR-15, "A word to New AR Owners" (August, 2009)

www.fulton-armory.com/M16Clean.htm "Cleaning and Lubricating the AR-15/M16/M16A1".

The firing chambers of all types of firearms are subjected to contamination and fouling due to gunpowder residues. The M16/AR-15 family of rifles was designed for rapid fire. The firing rate of the M16 military rifle is 600 rounds per minute. In rapid fire, substantial heat and pressure is generated by burning gunpowder gasses. Contaminants such as carbon, sand, and shavings from the metal cartridge cases become attached to the locking lugs. Said contamination and fouling has often led to an inoperative firearm. Said firearms are frequently used in law enforcement and counter-terrorism roles. Unexpected stoppages of the firearm can become life threatening emergencies for the operator.

The prior state of the art for cleaning rifle chambers utilizes a wide variety of cleaning brushes. Brushes are found in several configurations. A wide variety of chemical solvents are also available. Solvents are intended to be utilized in combination with a wide and varied range of fiber cleaning patches and mops. The C.J. Weapons System M16/AR-15 Chamber Cleaning Star U.S. Pat. D562,935, is one such mop. The aforementioned methods have all been held over from the era of manually operated firearms. These materials are commercially available through various gunsmithing supply businesses. Two such purveyors are Brownell's of Montezuma, Iowa and Midway Inc. of Columbia, Mo.

Due to their outdated design, brushes, mops, and their associated methods are less effective than the presently claimed embodiment. Newer formulations in chemical cleaning solutions have resulted in minor advancements in debris removal. Said solutions require extended intervals of time in which to attack and break down solid and semi-solid obstructions. Additionally, said chemicals may present hazards to the skin and eyes of the user. Chemicals may also prove very cumbersome to apply under field conditions, and can actually attract dirt and sand.

In summation, the brush and mop methods fall short when compared to the performance of the present embodiment in several ways. First, brushes that are flexible enough to be inserted into the chamber locking lugs are not rigid enough to scrape away metal fragments that have become affixed to the breech by high heat and pressure. A second weakness of the brush and mop method is the reliance on a set of attachments that is threaded onto a cleaning rod. The operator may turn the cleaning rod in the wrong direction under stress. The brush can become unthreaded and left inside the breech rendering the firearm inoperative. Brush and mop methods require several distinct steps. The new method, advanced by the present embodiment, completes said task in only one quick and simple step.

The Brownell's catalog carries a selection of dental styled tools for "scaling" or scraping the carbon and brass deposits (part number #700-401-516AD). One major problem with said dental tools is inaccuracy at locating the exact location of an obstruction inside of the rifle chamber. Additionally, under conditions of poor lighting, all of the aforementioned prior art clearly falls short of the claimed embodiment. One very recent U.S. Pat. No. D589,579 S was awarded on Mar. 31, 2009 to Nicholas Williams. Said patent issued for a "Locking Lug Pick for Firearm Cleaning" calls attention to the need for a tool to clean the locking lug area of a firearm, but unlike the claimed embodiment, it fails to include a means for removal of debris.

Other attempts to improve the original brush and mop method were introduced by McDonnell and Munz. U.S. Pat. No. 3,602,935 1971 Sep. 7, McDonnell et al, revealed this design. Another device was issued U.S. Pat. No. 3,765,045 1973 Oct. 16, Schneider et al.

U.S. Pat. No. 3,602,935 1971 Sep. 7, issued to McDonnell et al, utilized a "rotatable scraping tool having a plurality of edge portions for removing built-up carbon deposits from the interior of a firearm." The aforementioned invention provided a means of scraping, unlike previous brush and mop methods. But, the claim of "removing built-up carbon deposits from the interior of the firearm" clearly falls short of the current embodiment. The design claimed in the prior art by U.S. Pat. No. 3,602,935 1971 Sep. 7, McDonnell et al, does not include a debris capturing device of any description what so ever. The present embodiment not only provides a means to loosen debris. It also includes specially designed recesses to trap and retain said debris in each of the elongated fingers. Additionally, said recesses both contain and remove the debris in a single operation. The present embodiment also utilizes a "chamber-within-a-finger" design, rather than a single scraping edge design, as used in U.S. Pat. No. 3,602,935, 1971 Sep. 7, McDonnell et al and U.S. Pat. No. 3,765,045, 1973 Oct. 16, Schneider, et al. Additionally, the scraping head of the present embodiment is permanently attached to a retractable shaft. This prevents the scraping head from becoming unthreaded to be left blocking the firearm's breech. The prior art also missed this relevant detail.

An application, Ser. No. 819,212, filed 1969 Apr. 25 by Schneider, et al claimed that it was "both structurally and functionally distinguished from a previously filed application. The second invention utilized a design which allowed insertion of the scraping device "without regard to orientation" because it was expandable by a "cam-like action". U.S. Pat. No. 3,765,045, issued 1973 Oct. 16 Schneider, et al, reads, "Once inserted, the tool can be expanded by the simple, axially inward movement of the plug."

While U.S. Pat. No. 3,765,045 Schneider et al, may have been distinguishable from U.S. Pat. No. 3,602,935, McDonnel et al, each shares the same basic limitation. Along with U.S. Pat. D589,579S, Williams, in non of the patented inventions contain any form of debris trap for capturing and removing the debris. These inventions are clearly scraping tools, and not debris removing tools. Therefore, a second operation, such as using a brush or chamber mop, is still required to remove the debris.

Finally, the expandable, cam-like, plug mechanism of U.S. Pat. No. 3,765,045, Schneider, et al introduces a substantial risk. Once expanded inside the confines of the breech, said mechanism could become mechanically inoperative while expanded. This could occur, perhaps due to debris contamination. Said mechanism would remain stuck in the chamber rendering the weapon totally inoperative.

All three of these examples of the prior art were developed by practitioners obviously well skilled and experienced in the field. The U.S. Patent issue dates span four decades. Yet, all three examples completely fail to address the manner in which the carbon is actually transported from the inside of the firearm. Unlike any prior art, the presently claimed embodiment is designed to contact each of the locking lug surfaces at once. And with a simple rotary motion, both loosen and capture debris for immediate removal from the interior of the firearm.

SUMMARY

The present embodiment is specifically designed to remove debris from the breech and locking lugs of the AR-1S and M-16 family of rifles. And it finds particular application as a tool for performing immediate action, in a field environment. In the case of the M-16 family of rifles, the rear of the rifle breech or chamber is comprised of eight locking lugs, spaced evenly at forty-five degrees around the perimeter of the chamber. The chamber locking lugs are engaged by seven locking lugs of the bolt. (The bolt design utilizes only seven locking lugs, in order to use one lug-space for a claw-type spent cartridge extractor.) With a manually operated bolt action firearm the operator can apply an increasing amount of force upon the rifle bolt to overcome the resistance of accumulated debris.

The M16/AR-15 design relies solely upon the force of a single spring contained in the firearm's butt section. The spring must provide sufficient energy to perform the entire loading operation. Said limitation of spring energy, requires that the breech be kept relatively free of debris build-up. Quite often, the first indication of excessive debris build-up is a failure of the rifle's bolt to fully close on a cartridge case in the chamber. At that point, the firearm is inoperable until the stoppage can be cleared.

Accordingly, the present embodiment provides a foldable, field transportable, and specially formed hand operated cleaning tool. A one-step cleaning of the chamber locking lugs of the M16/AR-15 family of rifles is now possible. Said embodiment provides uniquely formed debris capturing recesses whose advantages for rapid debris removal in the field have remained heretofore un-discovered. By virtue of the present embodiment, a safer and faster method of debris removal has advanced the art. Said method can easily be employed under the harshest of field conditions.

DRAWINGS

Reference Numerals

1) Typical Rifle Chamber of the M16 \ AR-15 family, not part of claimed embodiment.
2) Round scraping head of the tool, including radially extending elongated fingers with recesses.
3) Tool shaft.
4) Debris trapping chamber.
5) Scraping edges around the rear axial face of head and fingers.
6) Angled scraping edges that form the opening to debris chamber.
7) Locking lugs located inside of a typical M16\AR-15 family chamber, not part of the claimed embodiment.
8) Tool handle.
9) Typical locking lug recesses for the M16\AR-15 chamber, not part of claimed embodiment.
10) Substantially sharp horizontal scraping edges.

DETAILED DESCRIPTION OF THE EMBODIMENT

Figure 1:
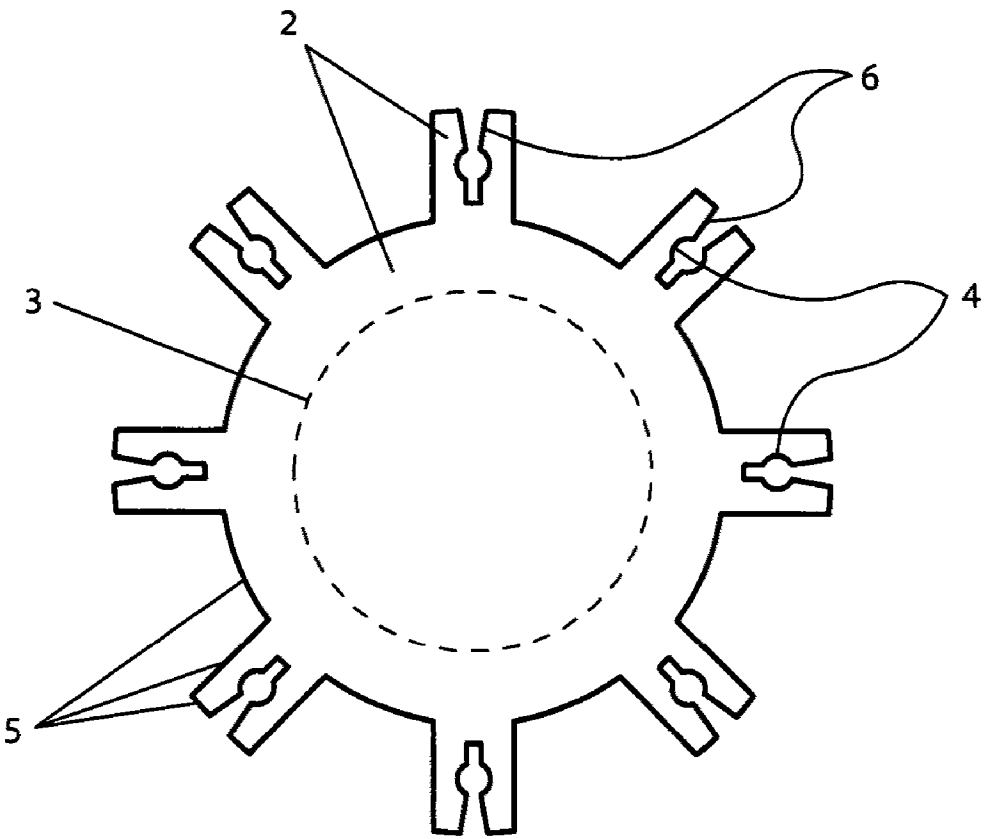
FIG. 1 is a rear view of the claimed embodiment, comprised of an annular scraping head, with a plurality of radially positioned elongated fingers. Each elongated finger is designed around an internal debris trapping chamber with a narrow opening formed by angled scraping edges.

FIG. 1 shows a rear facing view of the annular main body of the scraping head with elongated fingers (2). The scraping head (2) is preferably comprised of any suitable and durable material, including, but not limited to, metal and plastic. The scraping head (2) can be formed through various industrial processes such as water-jet cutting, laser jet cutting, investment casting, injection molding or wire (EDM) electrode discharge machining. The scraping head (2) is then permanently affixed, by pinning, set screws, welding, soldering, or other means, to the tool shaft (3) so that it cannot become "unthreaded" and left inside the rifle chamber, rendering the firearm inoperable. The debri capturing chamber (4) is formed by two opposing scraping edges within the elongated fingers of the scraping head. (2) Two opposed angled scraping edges (6) form the narrow entrance of the debris capturing chamber. Depending upon the method of manufacture, the debris capturing chambers, which face rearward, do not necessarily need to pass all the way through to the front face of the scraping head. The scraping edges (5) form the outer perimeter of the annular scraping head (2). The scraping head (2) is one solid object and has no moving parts that may become jammed or dislodged within the rifle chamber.

Figure 2:
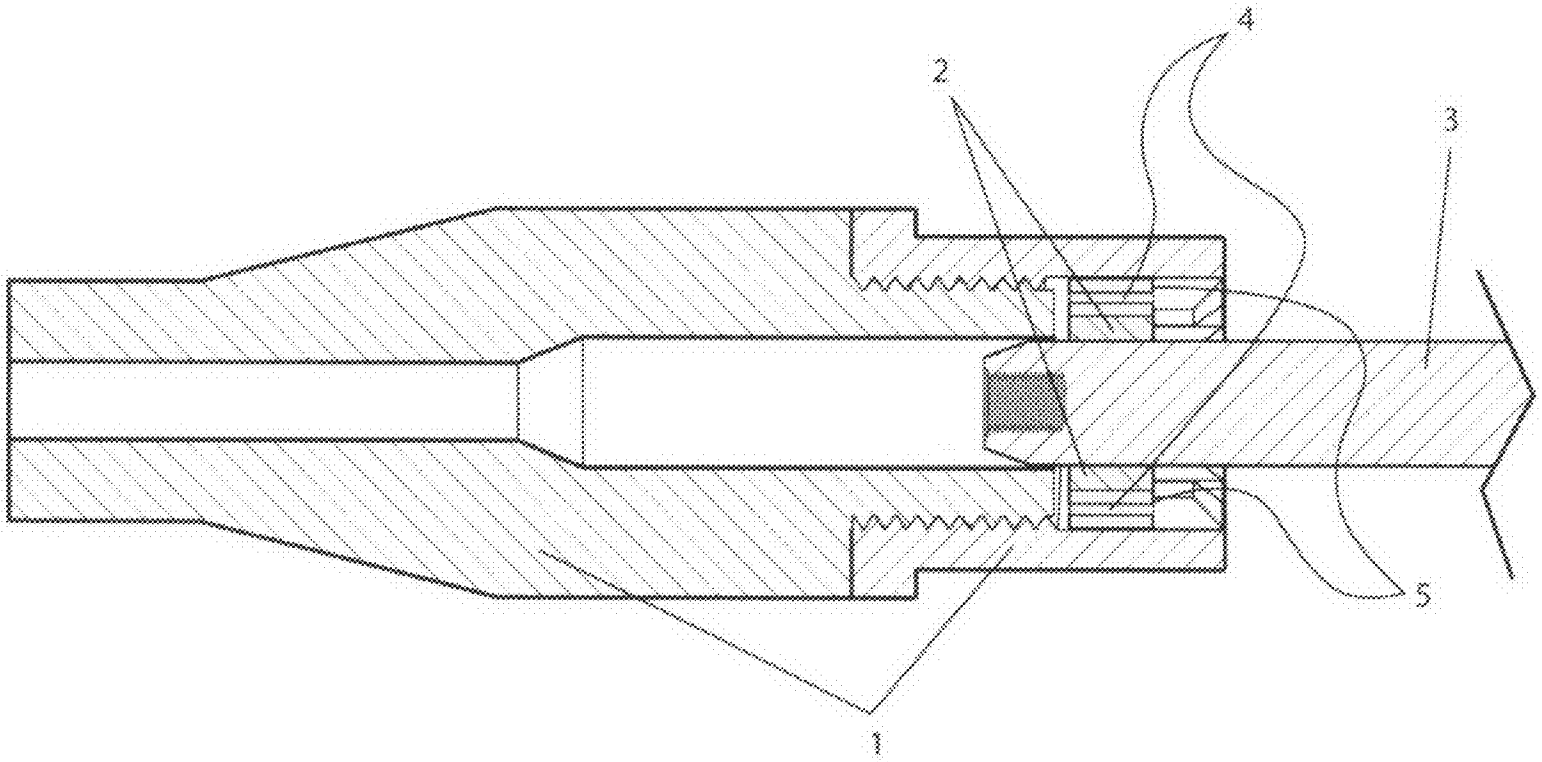
FIG. 2 is a side section view of the annular scraping head with debris trapping chambers mounted upon a tubular shaft and inserted into the firing chamber of a firearm of the M16\AR-15 design.

FIG. 2 shows a lateral sectioned view of the annular scraping head (2) with scraping edges (4), (5), and (6) mounted permanently upon shaft (3) and inserted into a typical M16\AR-15 rifle chamber (1).

Figure 3:
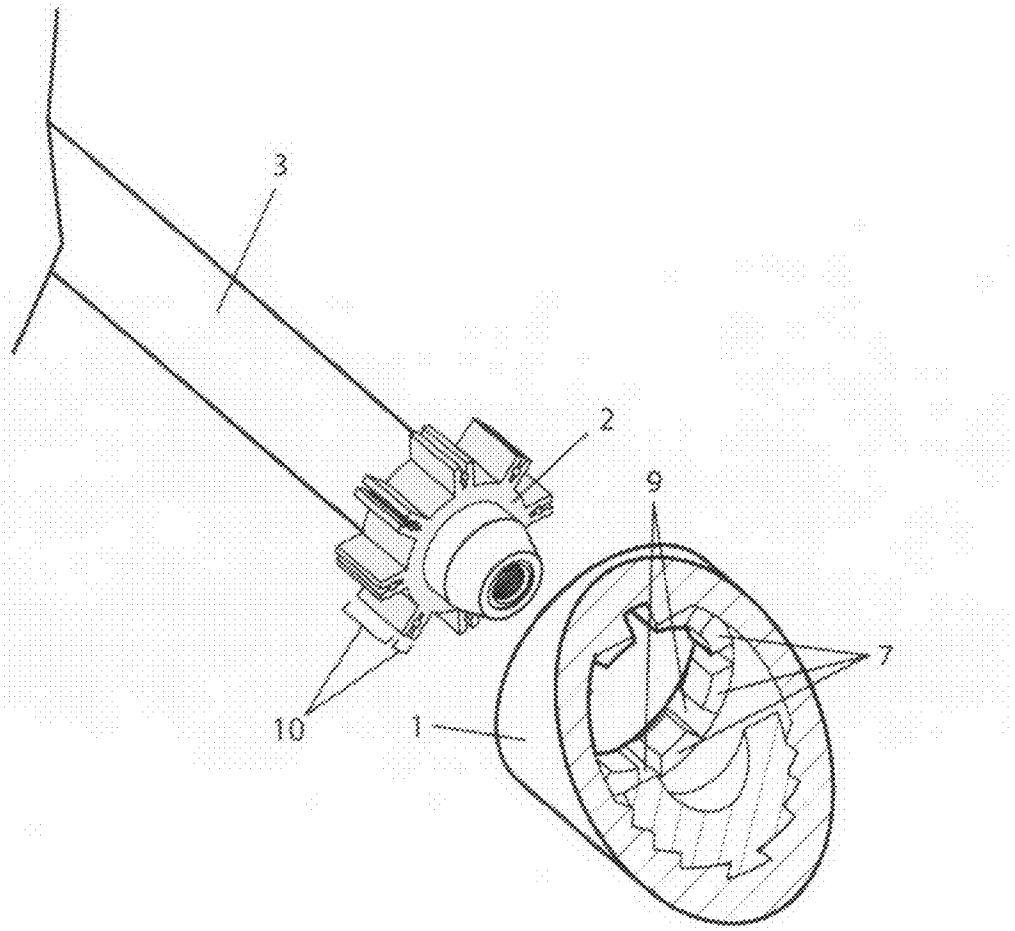
FIG. 3 is a perspective sectioned view of the annular scraping head mounted on a tubular shaft with the rear portion of the firearm chamber and locking lugs.

FIG. 3 shows the face of the rifle chamber locking lugs (7) used in the M16\AR-15 rifle chamber. When the scraping head (2) is inserted, the elongated fingers with external scraping edges (10) are dimensioned to pass closely through the recesses (9) between the locking lugs (7). The cleanliness of the locking lug (7) engagement area of the rifle chamber, where in the rifle bolt must freely rotate during the firing cycle, is crucial to reliable operation of the firearm.

Figure 4:
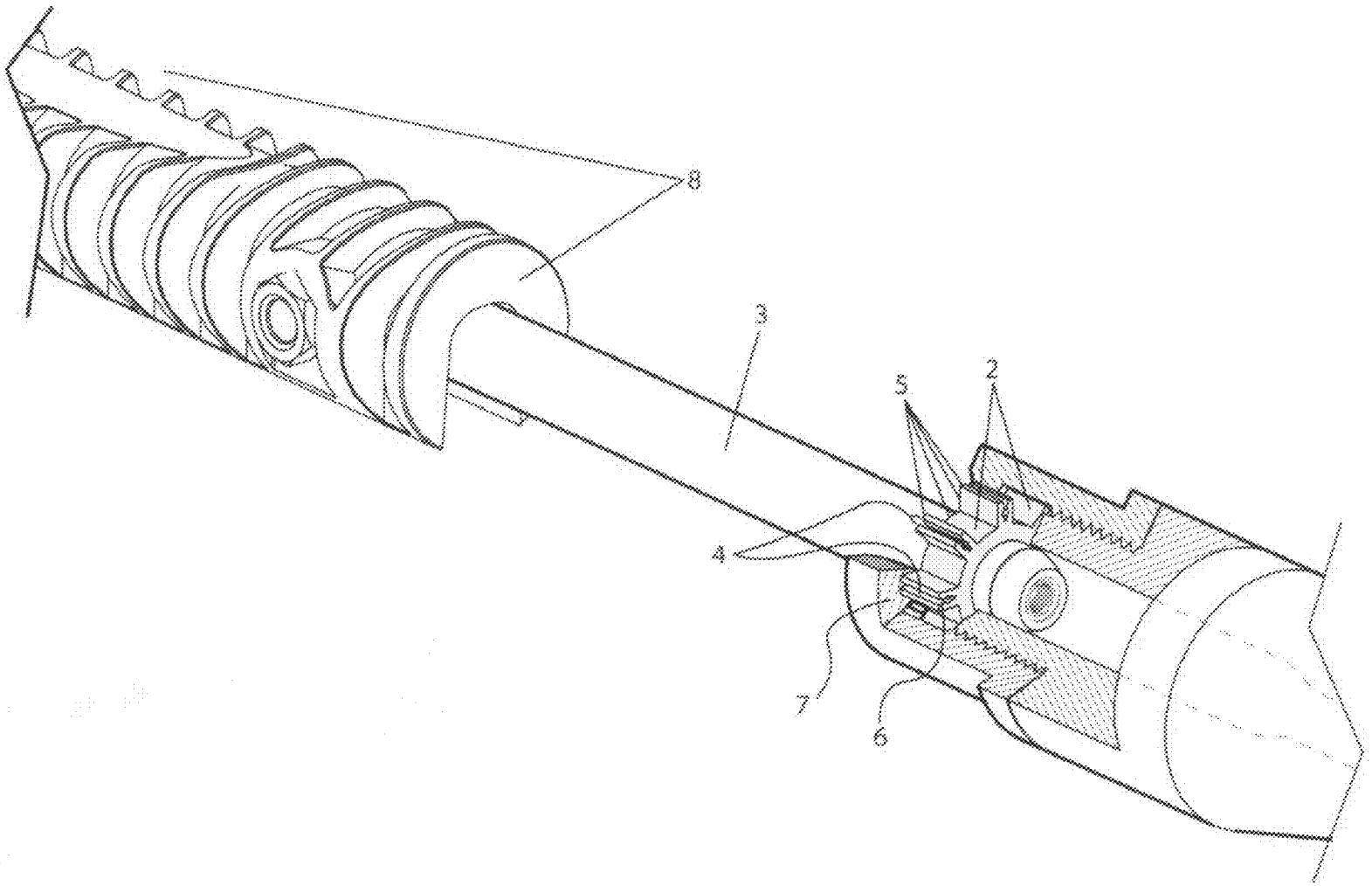
FIG. 4 is a perspective sectioned view of the rear axial face of scraping head engaging the forward facing surface of the rifle chamber locking lugs

FIG. 4 shows the substantially sharp rearward facing scraping edges (4) (5) and (6) of the scraping head (2) in contact with the front faces of the chamber locking lugs (7). The tool handle (8) with ribbed gripping grooves along the outside to facilitate its use with gloved hands, is also designed to allow the shaft (3) to be folded into the inside of the handle for storage and protection of the scraping head (2).

Operation:

After the scraping head (2) has been inserted into a dirty rifle chamber, the operator of the tool presses laterally on shaft (3) with the fingers of one hand, to cause the tool head to become slightly misaligned with the lug recesses through which it was inserted. This slight misalignment prevents the tool head from being extracted from the rifle chamber as the operator draws reward upon tool handle (8) with gentle pressure, while also rotating the tool. Drawing the tool handle (8) to the rear forces the scraping head (2) with scraping edges (4) (5) and (6) into contact with the dirty locking lugs (7), while the rotational motion of the handle (8) drags the fingers of the scraping head (2), with debris trapping chambers (4) across each of the eight chamber locking lugs (7) simultaneously. Debris loosened from the face of the lugs becomes immediately pressed within the confines of the debris chambers (4) within each finger on the tool head.

Conclusion:

The present embodiment has clearly advanced the state of the art by introducing the concept of a scraping and debris retaining tool that incorporates specially designed debris capturing recesses in each elongated finger. It provides a simple, but not obvious, solution to a problem that has eluded practitioners of the art for over forty years. And a new method of chamber cleaning, which guides the art away from the brushes, solvents, mops, and non-retentive scraping tools of the past, toward a new standard of safety and simplicity.

I claim:

1. A rifle chamber cleaning tool comprising:

a circular scraping head with a center, wherein the circular scraping head is situated around a tool shaft;

wherein the circular scraping head comprises a plurality of pairs of elongated fingers that extend radially and outwardly from the center of the circular scraping head, and wherein each pair of elongated fingers forms a debris-capturing recess between the elongated fingers;

wherein each elongated finger comprises a tip with an angled scraping edge for directing debris into the debris-capturing recess, wherein the debris-capturing recess comprises a first end and a second end, and wherein the angled scraping edge extends from the first end of the recess to the second end of the recess;

wherein each elongated finger has a length, wherein the length of each of the elongated fingers is the same as that of the other elongated fingers, and wherein the circular scraping head is at least as long as the elongated fingers;

wherein each elongated finger has an outer diameter, and wherein the outer diameter of each of the elongated fingers is the same as that of the other elongated fingers; and wherein the distance between the tips of the elongated fingers and the center of the tool shall is fixed.

2. The rifle chamber cleaning tool of claim 1, wherein each pair of elongated fingers has a width, wherein the circular scraping head further comprises spaces between the pairs of elongated fingers, and wherein the spaces between the pairs of elongated fingers are at least as large as the width of each pair of elongated fingers.

3. The rifle chamber cleaning tool of claim 1, wherein the tool shaft is pivotally attached to a tool handle that fully encloses the tool when the tool is not in use.

* * * * *